US006187391B1

(12) United States Patent
Kataoka et al.

(10) Patent No.: US 6,187,391 B1
(45) Date of Patent: Feb. 13, 2001

(54) METHOD FOR MODIFYING ONE SURFACE OF TEXTILE FABRIC OR NONWOVEN FABRIC

(75) Inventors: Seiichi Kataoka; Susumu Yoshikawa, both of Ikeda (JP)

(73) Assignee: Agency of Industrial Science & Technology, Tokyo (JP)

( * ) Notice: Under 35 U.S.C. 154(b), the term of this patent shall be extended for 0 days.

(21) Appl. No.: 09/218,029

(22) Filed: Dec. 22, 1998

(30) Foreign Application Priority Data

Dec. 26, 1997 (JP) ..... 9-367897

(51) Int. Cl.[7] ..... B05D 5/00

(52) U.S. Cl. ..... 427/569; 427/209; 427/389.9; 427/393.4; 427/412; 442/65; 442/66; 442/67

(58) Field of Search ..... 427/400, 491, 427/407.1, 389.9, 393.4, 209, 569, 412; 442/59, 65, 66, 67, 108

(56) References Cited

U.S. PATENT DOCUMENTS 4,507,539 * 3/1985 Sando et al. ..... 219/121 PY
4,550,578 * 11/1985 Sando et al. ..... 68/5 E
4,617,340 * 10/1986 Tanaka et al. ..... 524/588
4,845,132 * 7/1989 Masuoka et al. ..... 521/53
5,124,173 * 6/1992 Uchiyama et al. ..... 427/38
5,208,075 * 5/1993 Kroner et al. ..... 427/389.9
6,051,036 * 4/2000 Kusaki et al. ..... 8/494

* cited by examiner

*Primary Examiner*—Shrive Beck
*Assistant Examiner*—Jennifer Calcagni
(74) *Attorney, Agent, or Firm*—Arent Fox Kintner Plotkin & Kahn, PLLC

(57) ABSTRACT

Provided is a method for modifying one surface of a textile fabric or a nonwoven fabric, which comprises coating a sizing agent inactive to plasma treatment on one surface of a hydrophobic or hydrophilic textile fabric or nonwoven fabric, subjecting another surface of the textile fabric or the nonwoven fabric to low-temperature plasma treatment to form an active seed for a graft polymerization reaction, then graft-polymerizing this active seed with a polymerizable monomer, and thereafter removing the sizing agent coated on one surface of the textile fabric or the nonwoven fabric. Clothing in which sweat given in sports or the like can easily be shifted from one surface to another thereof and can easily be evaporated and which has wash and wear properties is obtained.

10 Claims, 3 Drawing Sheets

METHOD FOR MODIFYING ONE SURFACE OF TEXTILE FABRIC OR NONWOVEN FABRIC

BACKGROUND OF THE INVENTION

The present invention relates to a method for modifying one surface of a textile fabric or a nonwoven fabric in which properties which are different from those of the above-mentioned textile fabric or nonwoven fabric itself are imparted to one surface of the fabric.

The above-mentioned method of the present invention is that in order to obtain a textile fabric or a nonwoven fabric suitable as a material of sportswear which is excellent in the perspiration treatment owing to an excellent function of moving a moisture from one surface to another in the fabric and has wash and wear properties, only one surface of the textile fabric or the nonwoven fabric is improved.

More specifically, the present invention relates to a method for modifying one surface of a textile fabric or a nonwoven fabric which is excellent in water permeability and diffusibility and which has a durability, wherein one surface maintains a hydrophobic nature inherent in the fibers and only the other surface is modified to have a hydrophilic nature (water absorption and sweat absorption) without accompanying an external change, a change in air permeability and the like.

In the human body, a moisture is always evaporated from the skin at normal state for regulation of the body temperature and due to a physiological perspiration function. In the vigorous sport, an amount of sweat is increased to prevent an abrupt increase of the body temperature.

Accordingly, a humidity within the clothing is also increased in taking part in a vigorous sport. It is said that when a temperature is 33° C. and a humidity is 65% or more, sweat which reaches the body surface from the sweat gland cannot be gasified and perspiration in a liquid phase starts.

The increase in the amount of sweat inherently serves to decrease the increasing body temperature with evaporation heat. However, when sweat remains on the skin surface or retains on the clothing surface in contact with the skin, the regulation of the body temperature with evaporation heat does not function effectively, with the result that the temperature in the clothing and the amount of sweat are all the more increased.

On the contrary, when the body temperature starts to decrease after the sport, sweat which is present on the body surface or on the clothing surface in contact with the skin is evaporated to make one feel chill.

In order to prevent the uncomfortable feelings such as <stuffy feeling>, <sticky feeling> and <chill feeling> in or after the sport, the clothing is required which has such a comfort that sweat on the body surface can be absorbed quickly and released rapidly into the outside environment from the portion in contact with the skin.

When the conventional fiber materials are evaluated from this standpoint, a fiber material made of 100% of natural fibers of cotton, wool or the like absorbs sweat well because of the excellent water absorption. However, since this has an excellent water retention, sweat once absorbed is hardly evaporated, and a considerable amount of a moisture is left inside the fibers, so that drying takes much time. Meanwhile, a fiber material made of 100% of synthetic fibers has a low rate of water absorption when it is brought into contact with water, and has thus a poor water permeability. Accordingly, absorption or shifting of sweat is not conducted, inviting an uncomfortable feeling due to wetting with sweat.

A mixed fabric of natural fibers and synthetic fibers has also a defect that sweat absorbed is absorbed in natural fibers and a hydrous state is maintained, with the result that sweat (moisture) is hardly evaporated.

In order to solve these defects, a fabric in which one surface is hydrophobic and another is hydrophilic has been proposed.

FIGS. 1(A) through 1(C) are model views showing a water absorption and a water permeability of a hydrophobic textile fabric, a textile fabric in which both surfaces are hydrophilic, or a textile fabric in which one surface is hydrophobic and another is hydrophilic.

In the hydrophobic textile fabric of a fiber material made of 100% of synthetic fibers, a moisture permeation layer does not reach the outside as shown in FIG. 1(A). In the textile fabric of a fiber material made of 100% of natural fibers in which both surfaces are hydrophilic, a moisture permeation layer reaches the outside, and is uniformly distributed in the inside and the outside as shown in FIG. 1(B). In the textile fabric having the hydrophilic surface and the hydrophobic surface, the moisture permeation layer is enlarged from the hydrophobic surface to the hydrophilic surface as shown in FIG. 1(C).

With respect to the behavior of sweat truly required in the textile fabric for sportswear, working clothes entraining a large amount of sweat and the like, as mentioned above, what is important is not that sweat is absorbed into the textile fabric, but rather that sweat is moved from the hydrophobic surface in contact with the skin to the hydrophilic surface always in contact with open air without absorption into the textile fabric and is diffused and released into the surface layer. A fabric having a water absorption and a water permeability as shown in FIG. 1(C), namely, a fabric in which one surface is hydrophobic and another is hydrophilic can achieve such a behavior.

A variety of methods have been so far proposed for obtaining a textile fabric in which one surface is a hydrophobic surface and another is a hydrophilic surface. For example, it is known that in a post-treatment method in which a hydrophilic agent or a water-repellent agent is coated on one surface of a textile fabric, a textile fabric that does not give a stuffy feeling, a sticky feeling or the like can easily be produced. However, the textile fabric obtained by such a method has a poor washing resistance because the agent is simply coated thereon, and the textile fabric causes clogging by the agent coated, decreasing an air permeability.

A method has been also reported in which a textile fabric of synthetic fibers having a difference in function between front and back surfaces is obtained by imparting a hydrophilic nature to one surface of the textile fabric through plasma treatment using a low-temperature plasma method (for example, Japanese Patent Laid-Open Nos. 59-106,570 and 59-106,569). In this method, the textile fabric of synthetic fibers is fixed on an electrode surface in an inner electrode-type plasma device to treat one surface of the fabric. However, this method involves a problem that since the textile fabric has an air permeability, the overall fabric (both front and back surfaces) is plasma-treated in the plasma irradiation. Accordingly, no textile fabric having a satisfactory difference in function between front and back surfaces is obtained by such a method.

SUMMARY OF THE INVENTION

It is an object of the present invention to provide a method for modifying one surface of a textile fabric or a nonwoven fabric having a practical difference in function between front and back surfaces.

The present inventor has assiduously conducted investigations, and has consequently found that the above problem can be achieved by coating a sizing agent as a plasma reaction-preventing layer on one surface of a textile fabric or a nonwoven fabric before conducting low-temperature plasma treatment. This finding has led to the completion of the present invention.

That is, the present invention relates to a method for modifying one surface of a textile surface or a nonwoven fabric, which comprises coating a sizing agent on the whole or at least a part of one surface of the textile fabric or the nonwoven fabric, subjecting another surface of the textile fabric or the nonwoven fabric to low-temperature plasma treatment to form an active seed, then graft-polymerizing this active seed with a polymerizable monomer, and thereafter removing the sizing agent coated on one surface of the textile fabric or the nonwoven fabric.

The sizing agent is usually coated on the whole of one surface. It is possible that the sizing agent is coated partially, for example, in a pattern so that the surface not coated with the sizing agent is wholly modified and the coated surface is partially modified. Therefore, the field of application of the present invention can be widened by the above-mentioned perspiration treatment as well as by variously changing properties of a material to be graft-polymerized.

DETAILED DESCRIPTION OF THE PREFERRED EMBODIMENTS

Figures 1A, 1B, 1C:
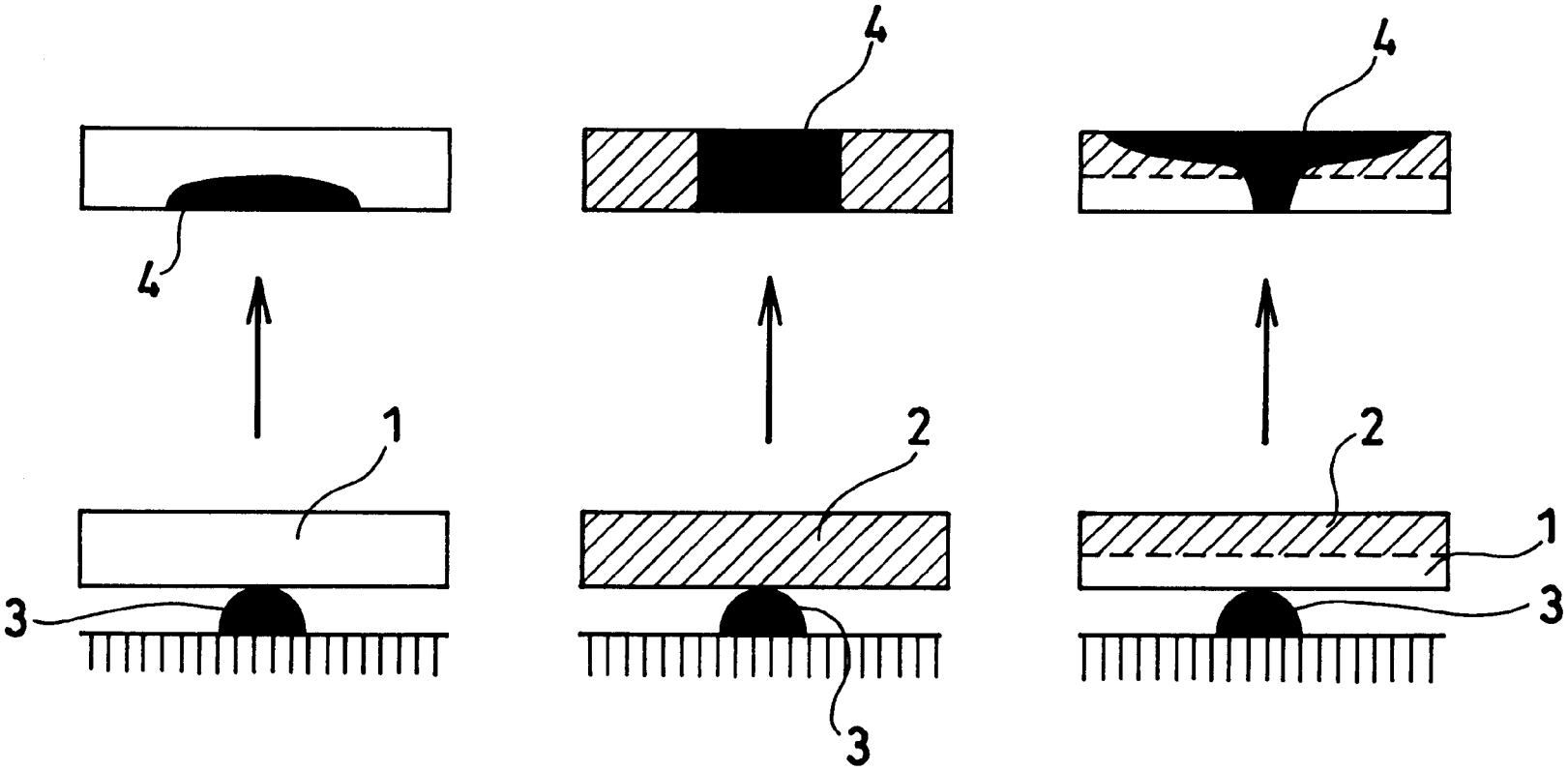
FIGS. 1(A) through 1(C) are model views of a water absorption and diffusion mechanism of a textile fabric.

The present invention is described in detail below.

A method for processing a textile fabric or a nonwoven fabric in the present invention includes four steps. The first step is a step of coating a sizing agent as a plasma reaction-preventing layer on one surface of a textile fabric or a nonwoven fabric; a second step is a step of activating another surface of the textile fabric or the nonwoven fabric through low-temperature plasma treatment; a third step is a step of graft-polymerizing a polymerizable monomer using a polymerizable active seed activated through the low-temperature plasma treatment; and a fourth step is a step of removing the sizing agent or the like coated on one surface of the textile fabric or the nonwoven fabric having a difference in function between front and back surfaces.

[First step]

In the first step of coating the sizing agent, the sizing agent is coated as the plasma reaction-preventing layer on one surface of the textile fabric or the nonwoven fabric.

The textile fabric or the nonwoven fabric intended by the present invention may be hydrophilic or hydrophobic. The hydrophobic fiber is preferable.

A textile fabric or a nonwoven fabric made of various synthetic fibers of a polyester, polypropylene, polyamide or polyacrylonitrile type as hydrophobic fibers can be mentioned. Further, a textile fabric or a nonwoven fabric made of blended fibers including polyester, polypropylene, polyamide or polyacrylonitrile fibers and 50% of cotton, flax, silk or wool fibers as at least hydrophilic fibers can be mentioned.

As the hydrophilic fibers, cotton, flax, silk or wool fibers can be mentioned.

The sizing agent which is used as the plasma reaction-preventing layer in the present invention is not particularly limited unless it has a direct influence on the textile fabric or the nonwoven fabric even if activated.

As a water-soluble sizing agent, for example, sodium alginate, starch, processed starch (dextrin, carboxymethyl starch or the like), a cellulose derivative (methyl cellulose, ethyl cellulose, carboxymethyl cellulose or the like), a synthetic paste (polyvinyl alcohol, polyacrylic acid or the like) and so forth can be mentioned.

In the method of the present invention, the sizing agents may be used either singly or in combination.

The water-soluble sizing agent is used in a paste form by adding water thereto. In this case, the concentration of the sizing agent can be changed, as required, depending on the type of the textile fabric or the nonwoven fabric to be coated. However, when the concentration is low and the permeability in the textile fabric or the nonwoven fabric is high, the sizing agent is permeated into the opposite surface when it is coated, and this is undesired. For example, the concentration of the above-mentioned sizing agent is preferably at least 0.5% by weight and at most 20% by weight, more preferably at least 0.5% by weight and at most 10% by weight.

A method for coating the sizing agent on the textile fabric or the nonwoven fabric is not particularly limited so long as it can uniformly be coated only on one surface of the textile fabric or the nonwoven fabric. For example, a coating method using a bar coater, a knife coater, a doctor coater or the like and a printing method using a screen or the like are mentioned.

The coating amount of the sizing agent is not particularly limited so long as it acts as a plasma reaction-preventing layer. For example, it can be coated such that the amount becomes between 40 $\mu$m and 60 $\mu$m after drying.

The sizing agent coated is dried by being allowed to stand, for example, in an atmosphere of 60° C. for from 15 to 20 minutes or in air for from 5 to 8 hours. Further, baking may be conducted as required.

[Second step]

In the second step, the textile fabric or the nonwoven fabric in which one surface is coated with the sizing agent as obtained in the first step is subjected to low-temperature plasma treatment.

Since the sizing agent becomes a plasma reaction-preventing layer, no active seed is formed in the surface coated with the sizing agent by the plasma treatment. Accordingly, it is possible to obtain the textile fabric or the nonwoven fabric in which only the other surface not coated with the sizing agent has a uniform, radical-polymerizable active seed (hereinafter simply referred to as an "active seed") by such a low-temperature plasma treatment.

The low-temperature plasma treatment is conducted by, for example, placing the textile fabric or the nonwoven fabric having one surface coated with the sizing agent in an inner electrode-type plasma device, continuously introducing a gas for low-temperature plasma treatment, and applying a voltage between electrodes.

The gas used in the low-temperature plasma treatment in the method of the present invention includes a gas free from an oxygen gas and capable of forming an active seed, an oxygen gas and an oxygen gas-containing mixed gas.

As the gas free from an oxygen gas and capable of forming an active seed, an argon gas, a helium gas, a nitrogen gas, a hydrogen gas, carbon dioxide and a mixed gas thereof are mentioned.

As the oxygen gas-containing mixed gas, air and the like are mentioned.

Further, the gas forming the "oxygen gas-containing mixed gas" along with the oxygen gas is not particularly limited. The above-mentioned argon gas and the like and the mixed gas thereof may be used.

When the gas free from the oxygen gas and capable of forming the active seed is used in the low-temperature plasma treatment, the surface of the textile fabric or the nonwoven fabric having one surface coated with the sizing agent is subjected to the low-temperature plasma treatment, and the oxygen gas or the oxygen gas-containing mixed gas is introduced into the plasma device whereby the resulting active seed is reacted with oxygen. Alternatively, after the plasma treatment, the textile fabric or the nonwoven fabric is taken out into ambient atmosphere, and the active seed formed on the surface is reacted with oxygen.

When the low-temperature plasma treatment is conducted in the oxygen gas or the oxygen gas-containing mixed gas, the above-mentioned procedure is not needed.

The thus-obtained active seed is one which is stable for a long period of time.

The conditions for the low-temperature plasma treatment are not particularly limited so long as the textile fabric or the nonwoven fabric in which only the other surface not coated with the sizing agent has the uniform active seed is obtained. For example, preferable conditions when using an ordinary inner electrode-type plasma device are described below.

A power source to which a voltage is applied is not particularly limited if a frequency capable of discharge is provided. In the experiment of the present invention, 13.56 MHz was used.

A discharge output is preferably between 0.1 $W/cm^2$ and 1 $W/cm^2$. A discharge time is 1 second or more, especially preferably between 5 and 60 seconds.

A gas pressure in the discharge is preferably between 0.1 mmHg and 20 mmHg, especially preferably between 0.1 mmHg and 10 mmHg, further preferably between 0.1 mmHg and 1 mmHg.

A flow rate of a gas is preferably between 30 ml/min and 300 ml/min, especially preferably between 100 ml/min and 200 ml/min.

When the low-temperature plasma treatment is conducted under the above-mentioned conditions, the largest amount of the active seed can preferably be formed without damaging the textile fabric or the nonwoven fabric.

[Third step]

In the third step, the surface of the textile fabric or the nonwoven fabric having the active seed as obtained in the second step is contacted with the radical-polymerizable monomer to conduct graft polymerization.

When the surface of the textile fabric or the nonwoven fabric having the active seed is contacted with the monomer, the surface of the textile fabric or the nonwoven fabric has been deaerated to 0.1 mmHg or less in vacuo to remove an oxygen gas and the like contained in the textile fabric or the nonwoven fabric, whereby the graft polymerization reaction proceeds more easily. Further, the vacuum deaeration may be conducted while the textile fabric or the nonwoven fabric is contacted with the monomer.

In the method of the present invention, the graft polymerization reaction of one surface of the textile fabric or the nonwoven fabric may be conducted in a liquid phase or in a gaseous phase.

However, when the reaction is conducted in the liquid phase, namely in the monomer solution, a homopolymer tends to be formed. A homopolymer formed is adhered to the textile fabric or the nonwoven fabric, and is difficult to remove in some cases. Further, in the liquid phase reaction, the polymerization tends to proceed, and an amount of the graft polymer to the textile fabric or the nonwoven fabric is increased. When the amount of the graft polymer is too large, the texture of the final textile fabric or nonwoven fabric is sometimes decreased.

Meanwhile, when the graft polymerization reaction is conducted in the gaseous phase, formation of the homopolymer is inhibited in comparison with the liquid phase reaction, and the amount of the graft polymer is easily controlled. In this case, the texture of the textile fabric or the nonwoven fabric is hard to decrease. Accordingly, in the method of the present invention, it is advisable to conduct the graft polymerization by the gaseous phase reaction.

The temperature of the graft polymerization reaction is selected, as required, in relation to the reactivity of the monomer and the reaction time, and it is not particularly limited so long as a desired amount of a graft polymer is obtained. It is preferably at least 40° C. and at most 80° C.

The reaction time is selected, as required, in relation to the reaction method, the reaction temperature, the type of the monomer and the like, and it is not particularly limited so long as a desired amount of a graft polymer is obtained. The reaction can be conducted, for example, for at least 30 minutes and at most 10 hours.

The radical-polymerizable monomer used in the present invention can be selected, as required, depending on the use of the textile fabric or the nonwoven fabric. When the textile fabric or the nonwoven fabric is hydrophobic, a hydrophilic monomer is used. When the textile fabric or the nonwoven fabric is hydrophilic, a hydrophobic monomer is used.

The radical-polymerizable monomer here refers to a monomer which has a carbon-carbon double bond and in which the polymerization reaction proceeds through chain polymerization.

Examples of the hydrophilic monomer include acrylic acid, methacrylic acid, 2-hydroxyethyl acrylate, 2-hydroxyethyl methacrylate and N-vinyl-2-pyrrolidone.

Examples of the hydrophobic monomer include perfluorooctylethyl acrylate and perfluorooctylethyl methacrylate.

The combination of the textile fabric or the nonwoven fabric and the radical-polymerizable monomer can be selected, as required, depending on the use purpose. Especially, the textile fabric or the nonwoven fabric obtained from the following combination of the textile fabric or the nonwoven fabric and the monomer is preferable because a function to shift a moisture from one surface to another of the textile fabric or the nonwoven fabric is excellent.

Preferable examples of a combination of a hydrophobic textile fabric or nonwoven fabric and a hydrophilic monomer include a combination of a polyester-type textile fabric or nonwoven fabric and acrylic acid, a combination of a polyester-type textile fabric or nonwoven fabric and methacrylic acid, a combination of a polyester-type textile fabric or nonwoven fabric and 2-hydroxyethyl acrylate, a combination of a polyester-type textile fabric or non-woven fabric and 2-hydroxyethyl methacrylate, a polyester-type textile fabric or nonwoven fabric and N-vinyl-2-pyrrolidone, a polyamide-type textile fabric or nonwoven fabric and acrylic acid, a combination of a polyamide-type textile fabric or nonwoven fabric and methacrylic acid, a combination of a polyamide-type textile fabric or nonwoven fabric and 2-hydroxyethyl acrylate, a polyamide-type textile fabric or nonwoven fabric and 2-hydroxyethyl methacrylate, a combination of a polyamide-type textile fabric or nonwoven fabric and N-vinyl-2-pyrrolidone, a combination of a polypropylene-type textile fabric or nonwoven fabric and acrylic acid, a combination of a polypropylene-type textile fabric or nonwoven fabric and methacrylic acid, a combination of a polypropylene-type textile fabric or nonwoven fabric and 2-hydroxyethyl acrylate, a combination of a polypropylene-type textile fabric or nonwoven fabric and 2-hydroxyethyl methacrylate, and a combination of a polypropylene-type textile fabric or nonwoven fabric and N-vinyl-2-pyrrolidone. Of these combinations, the combination of the polyester-type textile fabric or nonwoven fabric and acrylic acid is especially preferable.

Preferable examples of a hydrophilic textile fabric or nonwoven fabric and a hydrophobic monomer include a combination of a cotton-type textile fabric or nonwoven fabric and perfluorooctylethyl acrylate, and a combination of a cotton-type textile fabric or nonwoven fabric and perfluorooctylethyl methacrylate.

The amount of the monomer can be selected, as required, depending on the reaction conditions and the like, and it is not particularly limited if it is an amount by which a hydrophilic nature corresponding to the use can be imparted to another surface of the textile fabric or the nonwoven fabric. For example, it is between 0.3% by weight and 2.0% by weight, especially preferably between 0.5% by weight and 1.2% by weight based on the total amount of the textile fabric or the nonwoven fabric.

[Fourth step]

In the textile fabric or the nonwoven fabric obtained in the third step, the sizing agent remains while being coated on one surface. Accordingly, this sizing agent is removed in the fourth step. Since the homopolymer of the monomer and the unreacted monomer are adhered to the other surface, these can be removed simultaneously.

The removal can be conducted by an ordinary method for removing a sizing agent, an unreacted monomer and the like from the textile fabric or the nonwoven fabric. For example, it can be achieved by washing the same with warm water of at least 40° C. and at most 60° C. The sizing agent and the like may be removed, as required, through ultrasonic washing.

In this manner, the textile fabric or the nonwoven fabric in which only one surface is modified, namely which has a difference in function between front and back surfaces is obtained.

The case of partially coating one surface of the textile fabric or the nonwoven fabric with the sizing agent in practicing the present invention is described as follows. That is, the shape in partially coating the sizing agent is not particularly limited. It can be arranged in various patterns such as a striped pattern, a lattice pattern, a circular pattern, an elliptical pattern and the like, or in any optional pattern. The surface other than the surface wholly or partially coated with the sizing agent in the textile fabric or the nonwoven fabric is subjected to the low-temperature plasma treatment to form the active seed, and this active seed is partially graft-polymerized with the polymerizable monomer, after which the sizing agent can be removed.

EXAMPLES

The present invention is illustrated more specifically by referring to the following Examples.

Example 1

As a water-soluble sizing agent, sodium alginate was adjusted to 10% by weight with water. The sizing agent was coated on one surface of a polyester jersey by a screen method such that the thickness after drying was between 50 $\mu$m and 60 $\mu$m, and allowed to stand in an atmosphere of 60° C. for 15 minutes for drying. The polyester jersey used had a thickness of 0.85 mm and a weight of 272.4 g/m$^2$. Subsequently, the above-mentioned textile fabric was placed on a sample stand between inner parallel flat electrodes in an inner electrode-type plasma device (plasma treatment device supplied by Hirano Koon K.K.) for low-temperature plasma treatment. The low-temperature plasma treatment was conducted under such conditions that an inner pressure of the plasma device was 0.4 mmHg, an argon gas flow rate 100 ml/min, a plasma irradiation time 30 seconds and a discharge output 0.15 W/cm$^2$. After the completion of the plasma treatment, air was charged into the device which was under reduced pressure. The textile fabric was then withdrawn from the inside of the device.

The graft polymerization reaction was conducted in a gaseous phase. In a reaction device, a hydrophilic monomer was charged into a detachable, bottomed, vertical polymerization pipe having a capacity of 160 ml, and 3 or 4 tubes cut to from 2 to 3 cm were placed in this polymerization pipe in order not to bring the sample into contact with the above-mentioned monomer. And 2 ml of acrylic acid were collected as a hydrophilic monomer, and charged into the polymerization pipe. Subsequently, the textile fabric which had been subjected to the low-temperature plasma treatment was inserted into the polymerization pipe, and put on the glass tubes. The inside of the polymerization pipe was purged with a nitrogen gas, and deaerated to reduce the pressure to 0.1 mmHg. During the reaction, the reduced pressure was maintained. The reaction was conducted at a temperature of 60° C. for 8 hours.

After the completion of the polymerization, the textile fabric was withdrawn from the polymerization pipe, and dipped overnight in warm water to remove the sizing agent and the like. Then, the resulting fabric was dried.

The amount of the graft polymer of the resulting textile fabric was 0.5% by weight based on the total amount of the textile fabric, and the texture such as an appearance, a touch or the like was the same as that of the untreated textile fabric.

Example 2

As a water-soluble sizing agent, sodium alginate was adjusted to 10% by weight with water. The sizing agent was coated on one surface of the same polyester jersey as that used in Example 1 by a screen method such that the thickness after drying was between 50 $\mu$m and 60 $\mu$m, and allowed to stand at room temperature for 5 hours for drying.

Subsequently, the plasma treatment was conducted as in Example 1, and the graft polymerization reaction was conducted as in example 1 except that 2 ml of 2-hydroxyethyl acrylate were used instead of 2 ml of acrylic acid as a polymerizable monomer.

After the completion of the polymerization, the sizing agent and the like were removed, and the textile fabric was then dried, as in Example 1. The amount of the graft polymer of the resulting textile fabric was 0.5% by weight based on the total amount of the textile fabric.

Example 3

A grafted polyester jersey was obtained in the same manner as in Example 2 except that 2 ml of N-vinyl-2-pyrrolidone were used as a polymerizable monomer.

The amount of the graft polymer of the resulting textile fabric was 0.8% by weight based on the total amount of the textile fabric.

Comparative Example 1

A grafted polyester jersey was obtained in the same manner as in Example 1 except that a sizing agent was not coated as a plasma reaction-preventing layer. The amount of the graft polymer of the jersey was 0.8% by weight based on the total amount of the textile fabric.

Comparative Example 2

Since the plasma device used in the present invention uses inner parallel flat electrodes, it is impossible to protect one surface of a textile fabric by spreading the same on the electrode plates as described in the above-mentioned document in which the drum-type electrode is used. Accordingly, in Comparative Example 2, the textile fabric was fixed on a curved glass plate instead of the electrode plates using a cotton yarn, and the plasma treatment was conducted.

That is, a grafted polyester jersey was obtained in the same manner as in Example 1 except that the low-temperature plasma treatment was conducted such that the above-mentioned polyester jersey fixed on the curved glass plate with the cotton yarn without using the sizing agent as the plasma reaction-preventing layer was placed on the sample stand between the inner parallel flat electrodes in the plasma device.

The amount of the graft polymer of the resulting textile fabric was 0.6% by weight based on the total amount of the textile fabric.

[Tests for water absorption and water permeability]

The grafted polyester jerseys obtained in Examples 1 to 3 and Comparative Examples 1 and 2 were washed by a simple method according to JIS-0217-104. After the washing was repeated ten times, the tests for water absorption and water permeability were conducted with respect to each of the textile fabrics.

The water absorption and the water permeability were measured by the following method. First, exactly 0.1 cc of an ink solution (hereinafter referred to as "droplets") obtained by diluting commercial ink (blue black) to 2.0 times with water were added dropwise to a glass plate coated with a Teflon resin. Each of the polyester jerseys was put on droplets, and allowed to stand for 60 seconds. Subsequently, each of the polyester jerseys was moved to another glass plate coated with a Teflon resin, and allowed to stand for 3 minutes. Then, wet areas of both surfaces of each of the polyester jerseys were measured. The results are shown in Table 1.

TABLE 1

| | Hydrophilic monomer | Wet area ($cm^2$) Outside | Wet area ($cm^2$) Droplet side | Surface area (outside/droplet side) |
|---|---|---|---|---|
| Ex. 1 | Acrylic acid | 21.9 | 1.1 | 19.91 |
| Ex. 2 | 2-Hydroxyethyl acrylate | 10.8 | 1.2 | 9.00 |
| Ex. 3 | N-vinyl-2-pyrrolidone | 15.0 | 1.5 | 10.00 |
| Com. Ex. 1 | Acrylic acid | 6.7 | 6.5 | 1.03 |
| Com. Ex. 2 | Acrylic acid | 6.5 | 5.7 | 1.14 |

In the polyester jerseys obtained in Examples 1 to 3, the wet areas of the outside are increased to approximately 20 times, approximately 9 times and approximately 10 times relative to the wet areas of the droplet side respectively. This is consistent with the model view (C) of the textile fabric having both the hydrophobic surface and the hydrophilic surface in FIG. 1. Accordingly, it is found that in the polyester jerseys obtained in Examples 1 to 3, only one surface is modified to have a hydrophilic nature, and the fabrics have a difference in function between front and back surfaces.

On the other hand, with respect to the polyester jersey obtained in Comparative Example 1, the wet area of the droplet side is approximately consistent with that of the outside, and it is not enlarged. This is consistent with the model view (B) of the textile fabric having both hydrophilic surfaces in FIG. 1. Accordingly, it is found that when the graft polymerization is conducted with the plasma treatment without coating the sizing agent, both surfaces are modified to have a hydrophilic nature.

With respect to the polyester jersey obtained in Comparative Example 2, the same water absorption and water permeability as in the model view (B) are shown although the wet area of the outside is slightly larger than that of the droplet side. Accordingly, in the polyester jersey obtained by the method of Comparative Example 2, both surfaces are modified to have a hydrophilic nature in exactly the same manner.

Example 4 and Comparative Example 3

In Example 4 and Comparative Example 3, the grafting was conducted as in Example 1 and Comparative Example 1 except that a commercial polyamide jersey was used. With respect to the resulting grafted textile fabrics, the tests for water absorption and water permeability were conducted in the above-mentioned manner.

In the textile fabric obtained in Example 4, the wet area of the outside was larger than that of the droplet side. Accordingly, it was found that only one surface was modified to have a hydrophilic nature, and the fabric had a difference in function between front and back surfaces. Meanwhile, in the textile fabric obtained in Comparative Example 3, the wet area of the droplet side was approximately consistent with that of the outside. Thus, the wet area was not enlarged. Accordingly, it was found that in the textile fabric obtained in Comparative Example 3, both surfaces were modified to have a hydrophilic nature.

Examples 5 to 8 and Comparative Examples 4 to 7

In Examples 5 to 8 and Comparative Examples 4 to 7, one surface or both surfaces were grafted in the same manner as in Example 1 and Comparative example 1 except that the textile fabric used was replaced with a textile fabric of a polyester taffeta, a polypropylene plain weave, a polyamide taffeta and a polyacrylonitrile plain weave in this order.

In these textile fabrics, the thickness of the fabric was not satisfactory, and the dot of ink on the front surface was overlapped with the dot of ink on the back surface. Therefore, it was impossible to evaluate the difference in function between the front and back surfaces by the tests for water absorption and water permeability.

Then, with respect to these textile fabrics, the difference in function between the front and back surfaces was evaluated by a dyeing method with a cationic dye (Estrol dye: Estrol Red N-GSL, made by Sumitomo Chemical Co., Ltd.).

In the textile fabrics of the polyester taffeta, the polypropylene plain weave, the polyamide taffeta and the polyacrylonitrile plain weave obtained by the grafting as in Example 1 and Comparative Example 1, the graft polymerization with the acrylic acid monomer was conducted, and the acidic group (—COOH) of acrylic acid was present on the surfaces of the textile fabrics. In the cationic dye, dyeing was conducted with a salting bond between the cationic ion of the dye and the acidic group on the surface of the textile fabric, and the larger the number of the acidic group present on the surface, the fabric is dyed deeper. Accordingly, the difference in function between the front and back surfaces was evaluated in terms of the extent of the dyeing.

In the textile fabrics in Examples 5 to 8 in which the grafting was conducted in the same manner as in Example 1, one surface was dyed light, and the other surface was dyed deep.

On the other hand, in the textile fabrics in Comparative Examples 4 to 7 in which the grafting was conducted in the same manner as in Comparative Example 1, both surfaces were uniformly dyed deep.

Accordingly, in the textile fabrics of the polyester taffeta, the polypropylene plain weave, the polyamide taffeta and the polyacrylonitrile plain weave obtained in the same manner as in Comparative Example 1, the acidic group is present on both surfaces. It is said that both surfaces are modified to have a hydrophilic nature. On the other hand, in the textile fabrics of the polyester taffeta and the like obtained in the same manner as in Example 1, the acidic group is found to be present on one surface alone. It is said that only one surface is modified and the fabrics have the difference in function between the front and back surfaces.

Example 9

As a water-soluble sizing agent, sodium alginate was adjusted to 10% by weight with water. One surface of the same polyester jersey as that used in Example 1 was partially coated with a sizing agent in a striped pattern by a screen method such that the thickness of the sizing agent after drying was between 50 $\mu$m and 60 $\mu$m. Specifically, in the hydrophobic surface (1) shown in FIG. 1(C), the patterning was conducted such that the hydrophilic portion was arranged between the hydrophobic surfaces at intervals of 5 mm or less and the area ratio between the hydrophobic portion and the hydrophilic portion was between 30:1 and 1:1.

In the above-mentioned manner, the sizing agent was coated, and the fabric was then allowed to stand in an atmosphere of 60° C. for 15 minutes for drying. The same dry condition can also be obtained by the other drying method in which the fabric is allowed to stand at room temperature for 5 hours.

Subsequently, the plasma treatment was conducted as in Example 1, and the graft polymerization reaction was conducted as in Example 1 using 2 milliliters of acrylic acid as a polymerizable monomer.

After the completion of the polymerization reaction, the sizing agent and the like were removed, and the textile fabric was dried, in the same manner as in Example 1. The amount of the graft polymer of the resulting textile fabric was 0.5% by weight based on the total amount of the textile fabric.

[Tests for water absorption and water permeability]

Figure 2:
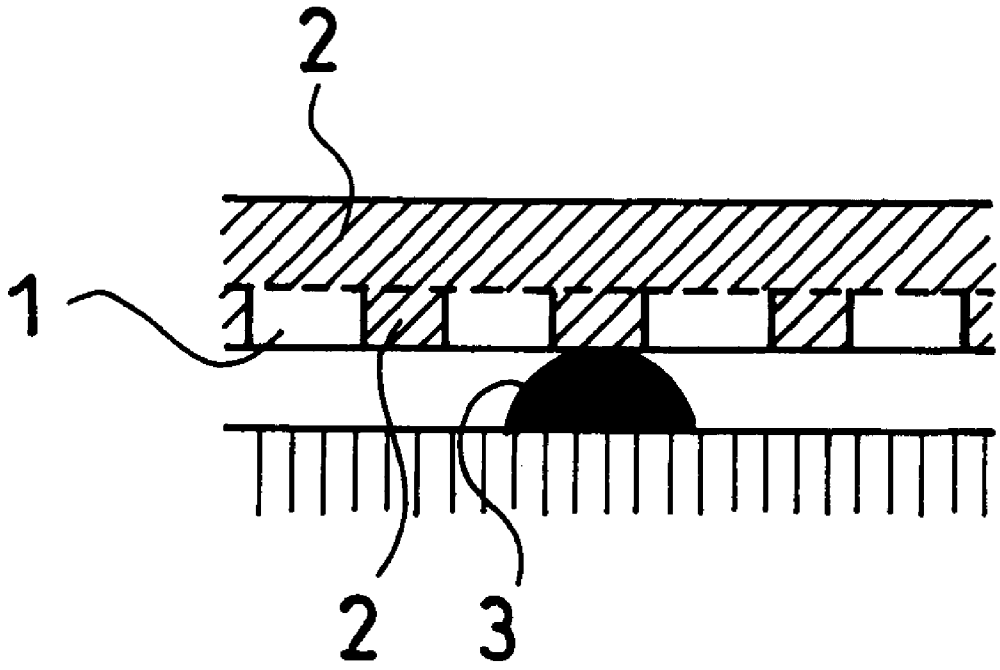
FIG. 2(A) is a model view of a test for water absorption of a modified textile fabric in Example 8.
FIG. 2(B) is a view in which a wet state of ink is traced on a striped surface in contact with ink.
FIG. 2(C) is a view in which a wet state of ink is traced on the wholly modified surface.
Figure 2:
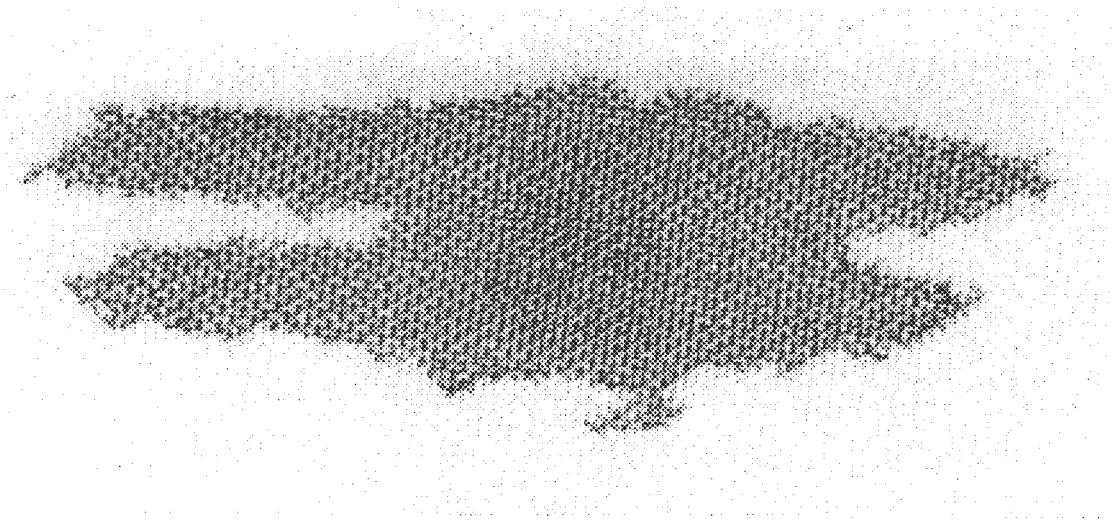
Figure 2:
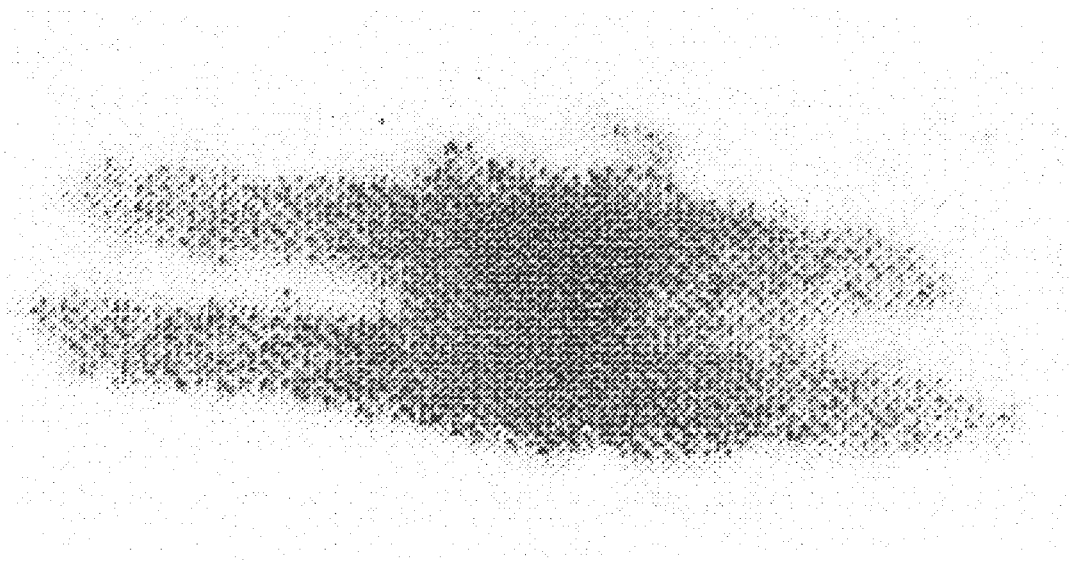

The partially grafted polyester jersey obtained in Example 9 was repeatedly washed ten times by the above-mentioned simple method according to JIS-0217-104. Subsequently, the textile fabric was subjected to the tests for water absorption and water permeability in the above-mentioned manner. The results are shown in FIG. 2.

As shown in FIG. 2(A), the textile fabric was placed such that the surface modified in the striped pattern was brought in contact with the ink solution. The textile fabric was caused to absorb ink, and then dried. FIG. 2(B) shows a state where the wholly modified surface was caused to absorb ink. FIG. 2(C) shows a state where the surface modified in the striped pattern was caused to absorb ink. According to the drawings, it is observed that the wet area of the surface in contact with ink [FIG. 2(C)] and the wet area of the opposite surface [FIG. 2(B)] are approximately the same, while the wet amount of the hydrophobic region (1) is small.

As mentioned above, the sizing agent is coated not wholly but partially, making it possible to conduct modification in various manners. Consequently, the field of use in the present invention can be widened by variously selecting chemical and physical properties of the graft polymer.

What is claimed is:

1. A method for modifying one surface of a textile fabric or a nonwoven fabric having a first and second surfaces opposite to each other, which comprises (1) coating a compound selected from the group consisting of sodium alginate, starch, dextrin, carboxymethyl starch, methyl cellulose, ethyl cellulose, carboxymethyl cellulose, polyvinyl alcohol and polyacrylic acid on a part of said first surface of the textile fabric or the nonwoven fabric, (2) subjecting said second surface of the textile fabric or the nonwoven fabric to a low-temperature plasma treatment to form an active seed on said second surface, (3) graft-polymerizing the active seed with a polymerizable monomer, and thereafter (4) removing said compound coated on said first surface to obtain the textile fabric or the nonwoven fabric having one surface modified with graft polymerization.

2. The method for modifying one surface of the textile fabric or the nonwoven fabric as recited in claim 1, wherein the textile fabric or the nonwoven fabric is hydrophobic, and the polymerizable monomer is hydrophilic.

3. The method for modifying one surface of the textile fabric or the nonwoven fabric as recited in claim 1, wherein the graft polymerization is conducted by a gaseous phase reaction.

4. The method for modifying one surface of the textile fabric or the nonwoven fabric as recited in claims 1, 2 or 3, wherein the sizing agent is coated in such an amount that the thickness after drying is between 40 $\mu$m and 60 $\mu$m.

5. The method for modifying one surface of the textile fabric or the nonwoven fabric as recited in claim 1, 2 or 3, wherein the amount of the polymerizable monomer is between 0.5% by weight and 1.2% by weight based on the total amount of the textile fabric or the nonwoven fabric.

6. A method for modifying one surface of a textile fabric or a nonwoven fabric having a first and second surfaces opposite to each other, which method comprises the following steps:

(1) coating a compound selected from the group consisting of sodium alginate, starch, dextrin, carboxymethyl starch, methyl cellulose, ethyl cellulose, carboxymethyl cellulose, polyvinyl alcohol and polyacrylic acid on the whole of said first surface;

(2) subjecting said second surface to a low-temperature plasma treatment to form an active seed on said second surface;

(3) graft-polymerizing the active seed on said second surface with a polymerizable monomer to form a graft polymer on said second surface without forming any graft polymer on said first surface; and thereafter (4) removing said compound coated on said first surface to obtain the textile fabric or nonwoven fabric having one surface modified.

7. The method for modifying one surface of the textile fabric or the nonwoven fabric as recited in claim 6, wherein the textile fabric or the nonwoven fabric is hydrophobic, and the polymerizable monomer is hydrophilic.

8. The method for modifying one surface of the textile fabric or the nonwoven fabric as recited in claim 6, wherein the graft polymerization is conducted by a gaseous phase reaction.

9. The method for modifying one surface of the textile fabric or the nonwoven fabric as recited in claims 6, 7, or 8, wherein the sizing agent is coated in such an amount that the thickness after drying is between 40 $\mu$m and 60 $\mu$m.

10. The method for modifying one surface of the textile fabric or the nonwoven fabric as recited in claims 6, 7, or 8 wherein the amount of the polymerizable monomer is between 0.5% by weight and 1.2% by weight based on the total amount of the textile fabric or the nonwoven fabric.

* * * * *